United States Patent [19]

Zeischegg et al.

[11] 4,200,194

[45] Apr. 29, 1980

[54] NESTABLE BASKET-TYPE CONTAINERS

[75] Inventors: Walter Zeischegg, Neu-Ulm; Bernd Brüssing, Ulm, both of Fed. Rep. of Germany

[73] Assignee: Hans Friedrich Hefendehl, Kierspe, Fed. Rep. of Germany

[21] Appl. No.: 960,729

[22] Filed: Nov. 14, 1978

[30] Foreign Application Priority Data

Dec. 15, 1977 [DE] Fed. Rep. of Germany ..... 2755858

[51] Int. Cl.[2] ..... B65D 21/04

[52] U.S. Cl. ..... 206/507; 206/518; 206/519

[58] Field of Search ..... 206/505, 507, 515, 518, 206/519, 520

[56] References Cited

U.S. PATENT DOCUMENTS

| | | | |
|---|---|---|---|
| 1,012,553 | 12/1911 | Hubbell | 206/515 |
| 2,889,072 | 6/1959 | Lapham | 206/507 |
| 3,404,804 | 10/1968 | Frater | 206/505 |
| 3,420,402 | 1/1969 | Frater | 206/507 |
| 4,011,948 | 3/1977 | Rehrig | 206/515 |

FOREIGN PATENT DOCUMENTS

| | | | |
|---|---|---|---|
| 211801 | 3/1967 | Sweden | 206/507 |

*Primary Examiner*—George E. Lowrance
*Attorney, Agent, or Firm*—Karl F. Ross

[57] ABSTRACT

An upwardly open container has a flat base with upper and lower sides and an outer peripheral edge defining a predetermined shape. An array substantially of this shape of generally parallel strips extending generally perpendicularly upwardly from the base defines the sides of the container with each of the lower ends of each of the strips secured to the outer peripheral edge. These strips each have a predetermined width measured parallel to the edge and a predetermined thickness measured perpendicular to the edge, and are equispaced apart along the edge by a distance equal to at least this width. A flat rim has an inner edge of the above-mentioned shape and larger in at least one direction parallel to the base than the corresponding portion of the peripheral outer edge of the base by a difference equal to at least twice the strip thickness. The upper ends of these strips are secured to the inner edge. Thus at least two of these containers can nest within each other with the lower face of the base of the upper container resting on the upper face of the base of the lower container and the strips of the containers interleaved. The base, rim, and arrays may be circular and angular. It is also possible for the shape to be a pair of parallel lines formed by opposite sides of a rectangular base and rim having another closed side and an open side. The distance between adjacent strips is a whole-number multiple of the strip width for nesting of a plurality of such containers together.

8 Claims, 13 Drawing Figures

FIG. 5
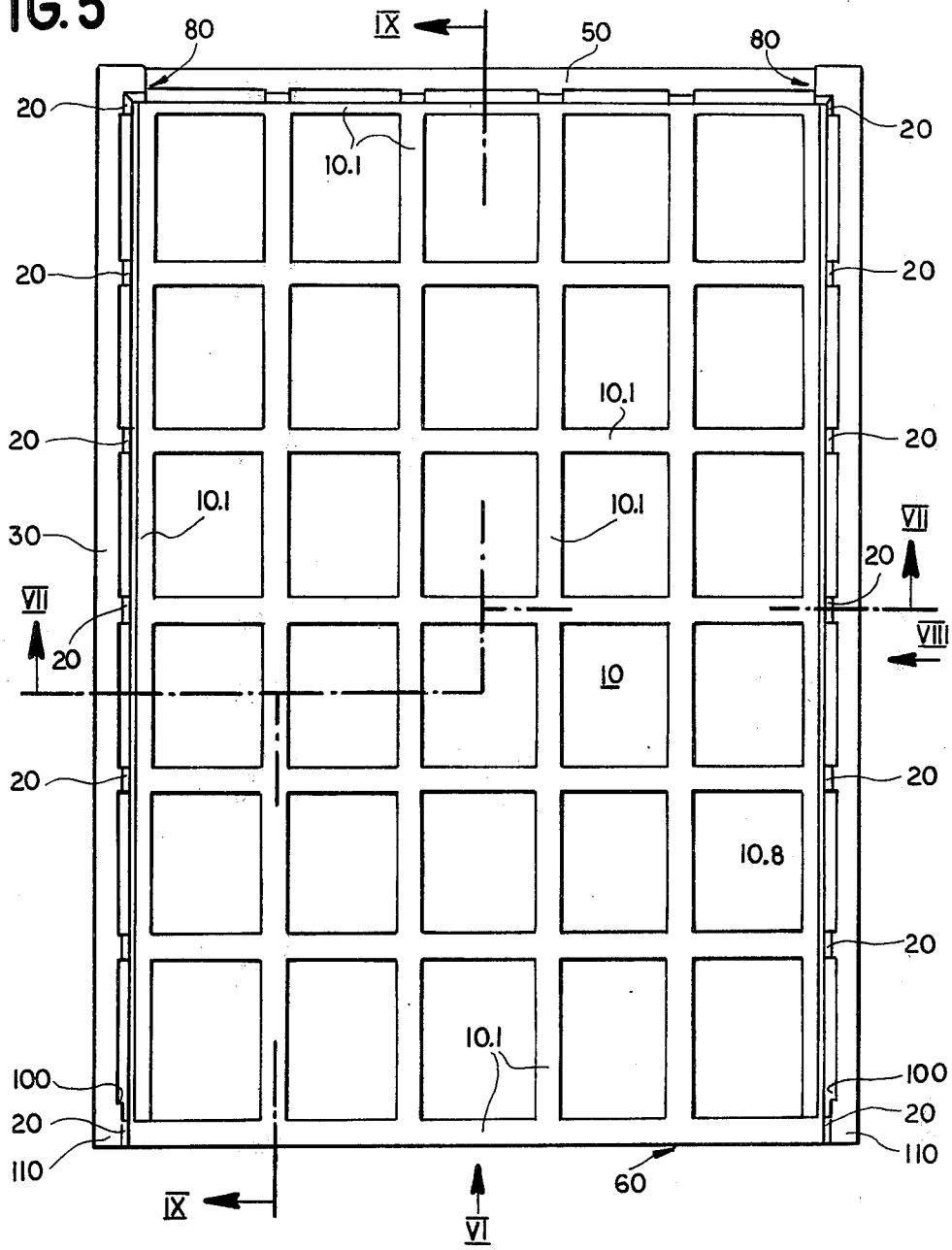
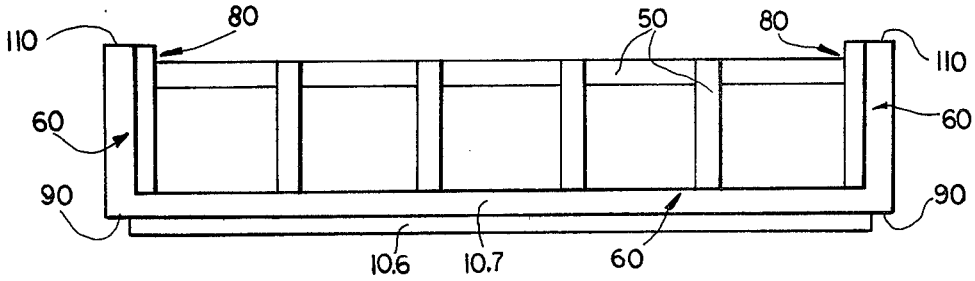
FIG. 6

NESTABLE BASKET-TYPE CONTAINERS

FIELD OF THE INVENTION

The present invention relates to an upwardly open container. More particularly this invention concerns such a container of the basket type which can be nested with a plurality of other such containers.

BACKGROUND OF THE INVENTION

A re-usable shipping container is known which is upwardly open, basket-fashion, and which is designed to nest with a plurality of other such containers. Accordingly the sides of such a container are upwardly flared. This flare is necessary to prevent the containers from wedging together when nested. When the angle of flare is less than 15°, that is when the angle defined between two sides is less than 30°, it has been found that the containers often become stuck together and extremely difficult to separate. Furthermore when the amount of flare is insufficient the bases of adjacent nested-together containers are separated somewhat from each other so that, even though nested together, a plurality of such containers takes up an inordinate amount of space.

The disadvantage of such containers is that they are not very stable, having bases of reduced area. Furthermore such containers do not use the available space efficiently, as only near their tops are they of full width. Thus adjacent their bases the space taken up by such containers is relatively empty.

OBJECTS OF THE INVENTION

It is therefore an object of the present invention to provide an improved container.

Another object is the provision of an improved upwardly open basket-type container which can be nested snugly within other such containers.

A further object is to provide such a container which not only can nest tightly with other containers, but which uses its volume efficiently for holding or storage.

SUMMARY OF THE INVENTION

These objects are attained according to the instant invention in a container having a flat base and upper and lower faces separating an outer peripheral edge defining a predetermined shape. Extending generally perpendicularly upwardly from this base is an array substantially of this shape of generally parallel strips each having a lower end secured to the outer peripheral edge and an upper end. These strips each have a predetermined width measured parallel to the edge and a predetermined thickness measured perpendicular to the edge. Furthermore the strips are generally equispaced along the edge in the array by a distance equal to at least the width. A flat rim has an inner edge of substantially the shape of the array and edge of the base but larger in at least one direction parallel to the base than the corresponding portion of the peripheral outer edge of the base by a difference at least equal to twice the thickness of the strips. The upper ends of the strips are secured to the inner edge of this flat rim so that at least two of these containers can nest within each other with the lower face of the upper container resting on the upper face of the lower container and the strips of the containers interleaved.

As described above, the term generally perpendicular refers to an angle of between 90° and 105° defined between the side strips and the base.

Thus with the system according to the instant invention it is possible to snugly fit at least two of these containers together so that they take up virtually no more space than one such container. In fact, the nesting of a second container inside the first container only increases the height of the nested containers over one container by the thickness of the base of one of the containers. Since the sides need not be flared at all, although in practice it is convenient when molding these containers of synthetic resin to flare them slightly, the containers make extremely efficient use of the space they occupy. When the space between adjacent strips is equal to a multiple of the strip width it is possible to nest a corresponding number of containers together.

According to further features of this invention the container may be generally circular in horizontal section. Thus the edges and arrays are annular and circular.

It is also possible according to this invention to make the assembly basically rectangular in horizontal section. To this end the arrays are actually constituted by a pair of parallel rows or lines in each of which the strips are parallel and equispaced. These two rows of strips occupy two of the opposite parallel sides of the rectangular base. One of the other sides is closed and similarly formed whereas the fourth side, opposite the closed side that bridges the two parts of the array, is open. Such a tray-like container is ideally suited for shipping paper products, such as magazines or the like.

An advantage of the structures according to this invention is that the containers can be stacked on top of each other without nesting when the strips are exactly aligned, so that the bottoms of the strips of the overlying container stand on the tops of the strips of the underlying container. Limited shifting of the containers relative to each other, however, allows them to nest one within the other for extremely compact storage and shipping of the empty containers. Since the strips are interleaved when the containers are nested together it is virtually impossible for two such containers to wedge together. Thus in spite of the relatively close fit between nested-together containers they can readily and easily be separated when desired.

BRIEF DESCRIPTION OF THE DRAWING

FIG. 5 is a top view of another container according to this invention;

FIG. 6 is a section taken in the direction of arrow VI of FIG. 5;

SPECIFIC DESCRIPTION

Figure 2:
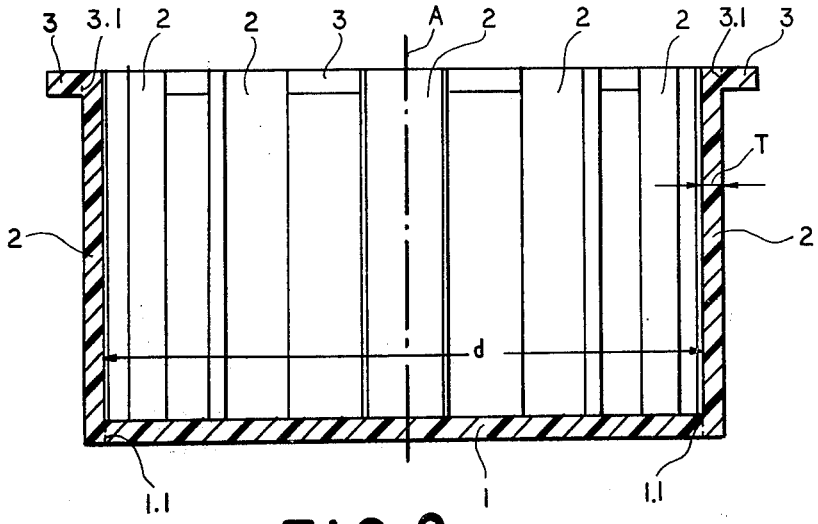
FIG. 2 is a section taken along line II—II of FIG. 1.
Figure 1:
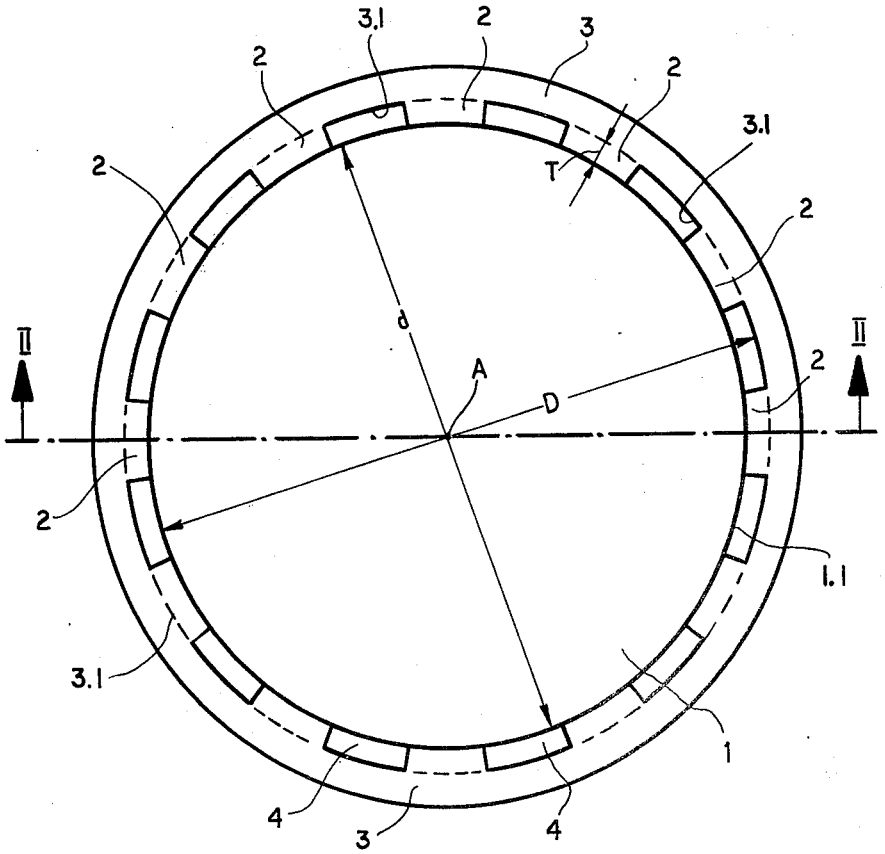
FIG. 1 is a top view of a container according to this invention.

FIGS. 1 and 2 show a container centered on an axis A and having a circular base 1 lying in a plane perpendicular to the axis A and having a circular outer edge or periphery 1.1 defining a diameter d. Twelve identical vertical strips 2 each have a lower end engaging radially inwardly against and unitarily formed with the base 1 at the outer periphery 1.1 thereof. These strips 2 are angularly equispaced and each have an angular length of slightly less than 15°. A circular rim has a circular inner periphery 3.1 defining a diameter D equal to the diameter d plus twice the thickness T of the strips 2 measured radially of the axis A. In fact the strips 2 are inclined slightly outwardly from each other so as to define between each other an angle of 4°. This slight inclination makes it possible to form the entire container of synthetic-resin material unitarily in one piece and to extract it from its mold with ease.

Figure 4:
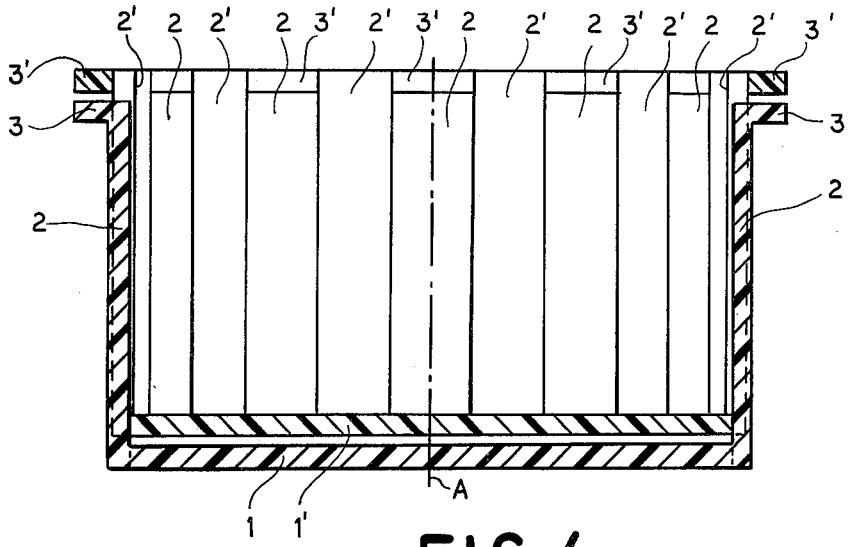
FIG. 4 is a section taken along line IV—IV of FIG. 3.
Figure 3:
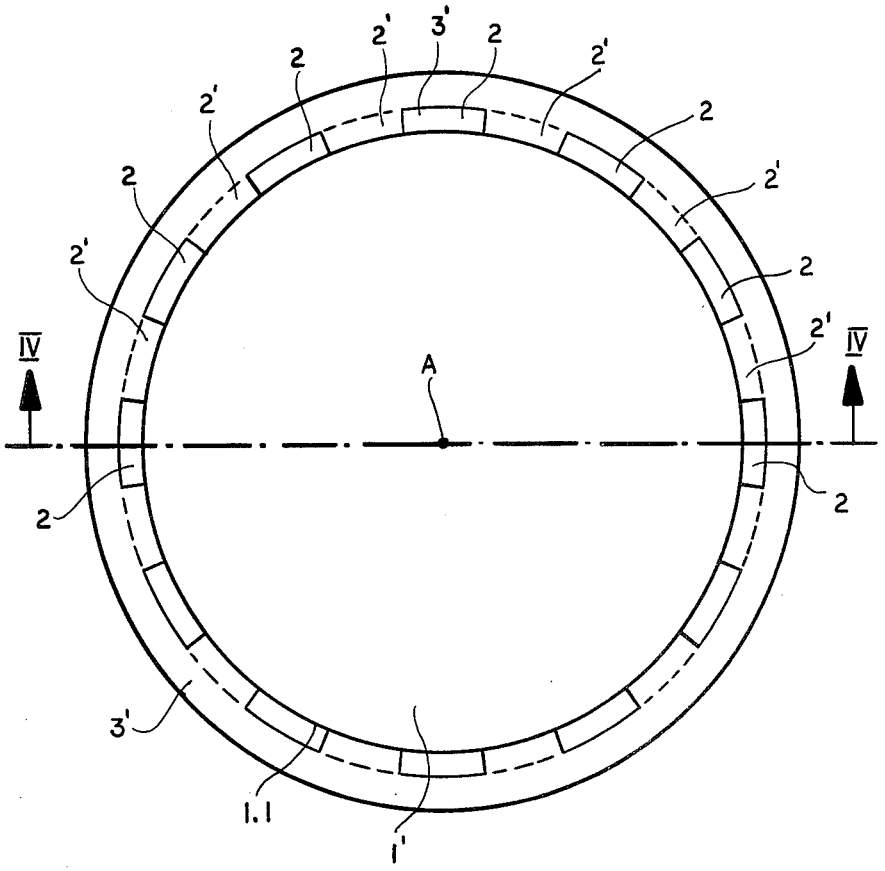
FIG. 3 is a top view showing two of the containers of FIGS. 1 and 2 nested together.
Figure 7:
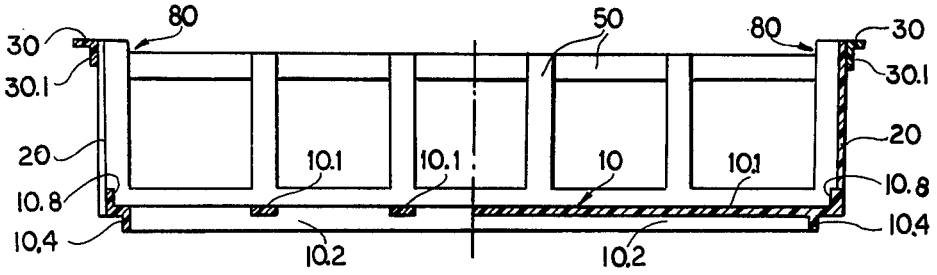
FIG. 7 is a section taken along line VII—VII of FIG. 5.
Figure 8:
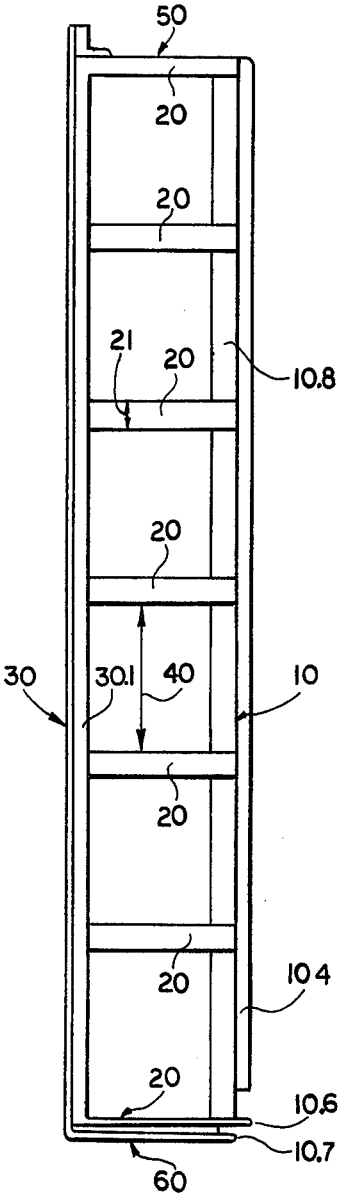
FIG. 8 is a view taken in the direction of arrow VIII of FIG. 5.
Figure 9:
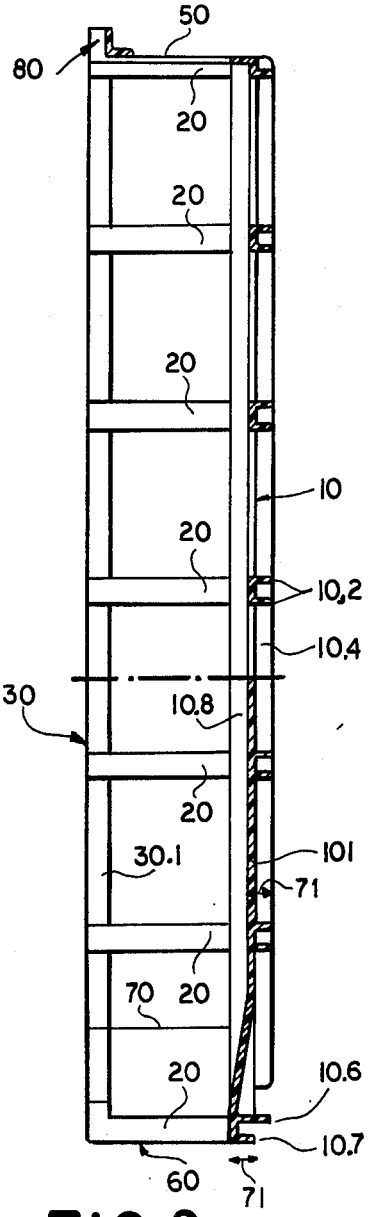
FIG. 9 is a section taken along line IX—IX of FIG. 5.
Figure 10:
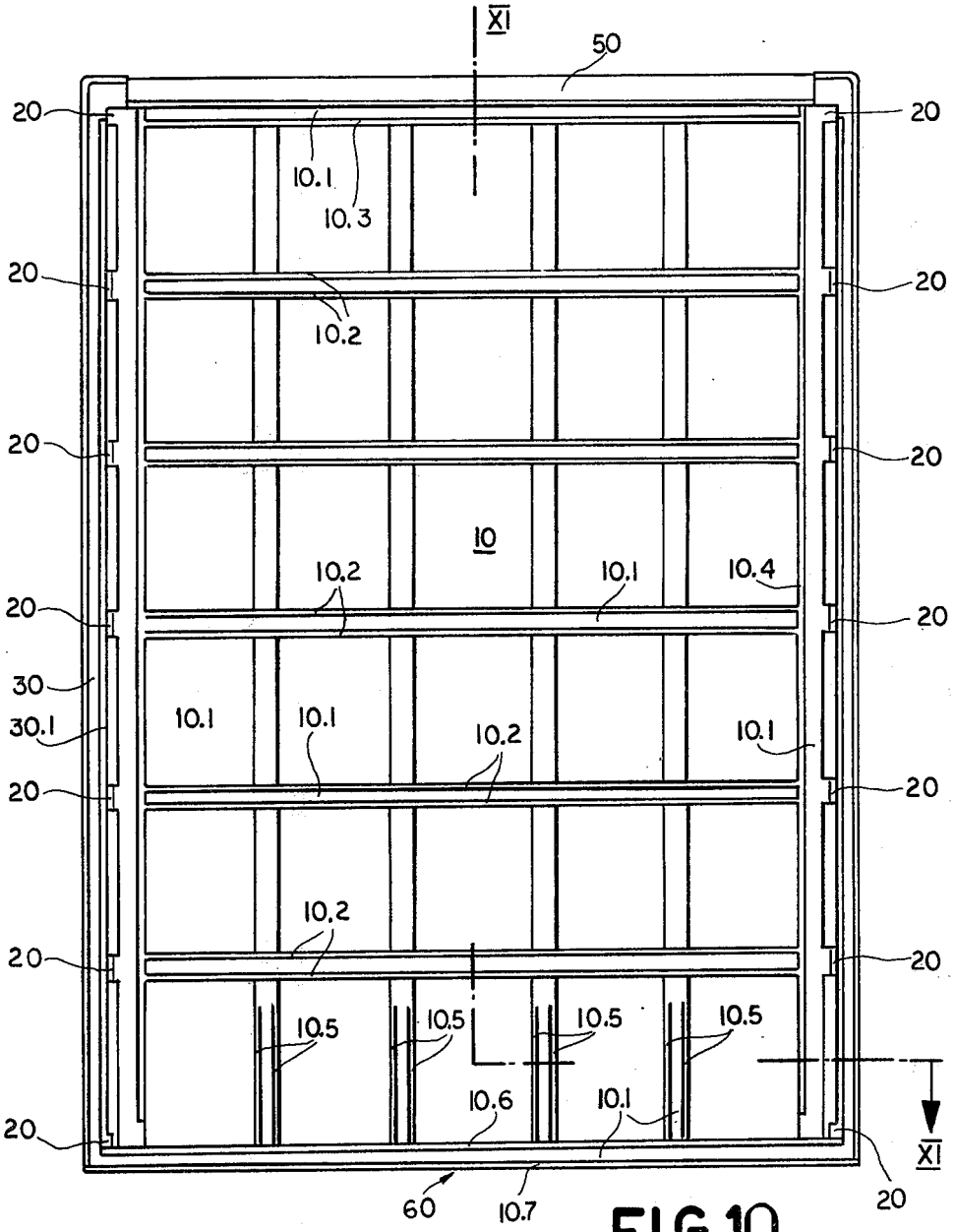
FIG. 10 is a bottom view of the container of FIG. 5.
Figure 11:
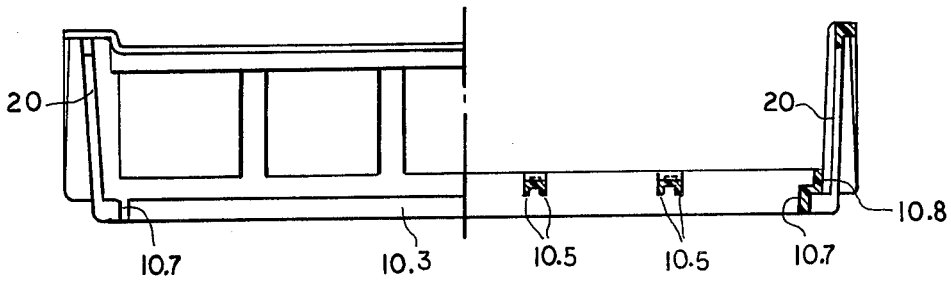
FIG. 11 is a section taken along line XI—XI of FIG. 10.

It is therefore possible, as seen in FIGS. 3 and 4, to take a container such as shown in FIGS. 1 and 2 and nest it with another container such as shown in FIGS. 3 and 4 wherein like reference numerals with primes apply to functionally identical structure. Thus the strips 2 will be interleaved with strips 2'. The rim 3' will lie on rim 3 and base 1' will lie on base 1. The result is an extremely compact assembly, taking up virtually no more room than a single such container as can readily be seen by comparison of FIGS. 2 and 4.

It is of course within the scope of this invention to reduce the angular dimension of the strips 2 and/or 2' to, for example, 10° so that three such containers could be nested together. Corresponding reductions of the width of the strips, with increases in the spacing between them, allows a plurality of such basket-like containers to be nested together.

The arrangement in FIGS. 5–11 employs the same general principle. Here an openwork base 10 is formed by six longitudinally extending strips 10.1 and seven transversely extending strips 10.1, crossing each other at right angles and reinforced by downwardly projecting webs 10.2–10.7. Each of the furthest-out longitudinally extending side strips 10.1 is provided with an upstanding edge strip 10.8 of rectangular section. This strip 10.8 constitutes the outer peripheral edge of the base 10. The two sides of the base 10 are each provided with upright strips 20 identical in functions to the strips 2 and here slightly outwardly flared as best seen in FIG. 11, again for demolding purposes. These strips 20 are equispaced along the two sides 10.8 by distances 40 equal here to six times the transverse width 21 (see FIG. 8) of these strips 20. The upper ends of the strips 20 are secured to the vertical flange 30.1 of a rim 30. The sides continue around the one end 50 of the basket and the rim 30 continues as rim 80 around this closed end. The other end 60 is left completely open so that the container is a tray. The container has a height 70 above the base 10 which is equal to six times the effective thickness 71 of the floor or base 10.

Figure 12:
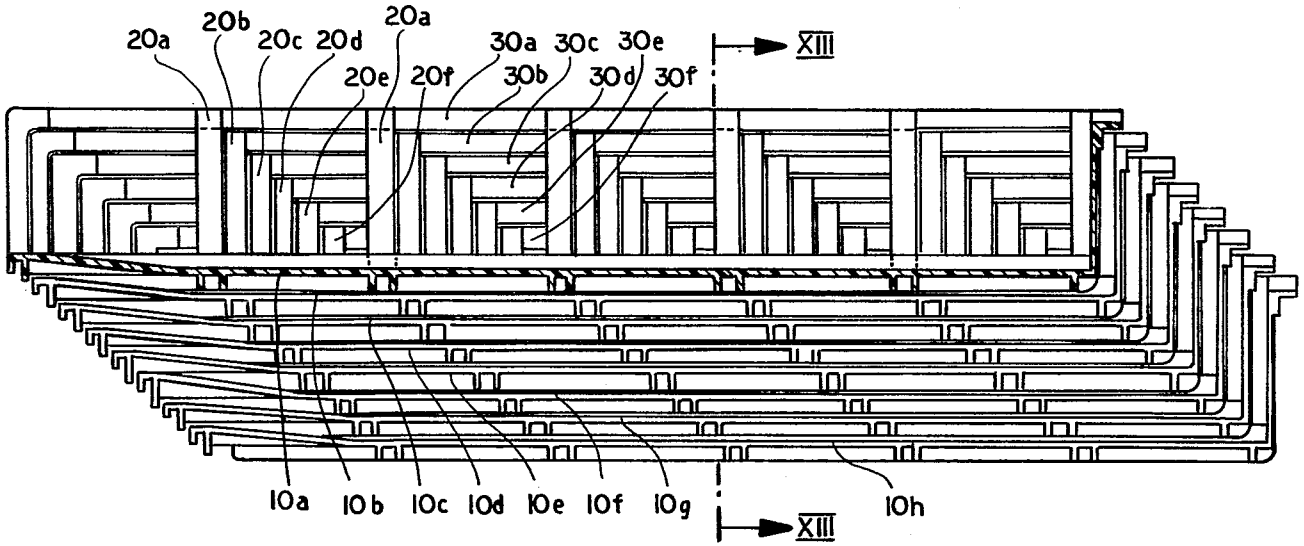
FIG. 12 is a longitudinal section through a nested-together stack of the containers of FIG. 5.
Figure 13:
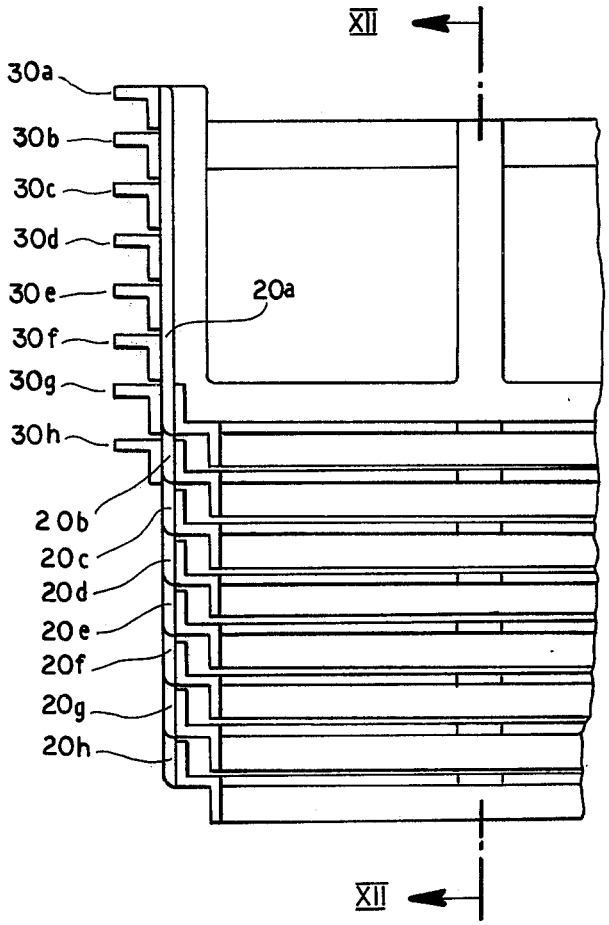
FIG. 13 is a section taken along line XIII—XIII of FIG. 12, line XII—XII of FIG. 13 indicating the section plane for FIG. 12.

It is possible as shown in FIGS. 12 and 13 to stack together eight such containers having identical bases 10*a*–10*h*, identical side strips 20*a*–20*h*, and identical upper rims 30*a*–30*h*. Since the spacing 70 between adjacent strips is equal to six times the thickness 71, and also equal to six times the thickness 21 of these strips, it is apparent that the strips 20*b*–20*g* will fit between strips 20*h*, and that the strips 20*a* will again be superposed directly over strips 20*h*. As the overall height of a stack of six bases 10*b*–10*g* is equal to the height 70, such superposition is completely possible. In fact such containers can be stacked several hundred high, and will take up very little room when thus stacked.

It is possible to stack these containers atop each other without them nesting together. This is easily achieved by standing each of the containers on top of the underlying container, with the rear end of the underlying reinforcing rib 10.4 received on the rim 80 and the ribs 10.6 lying on the underlying shoulders 100, the laterally projecting parts 90 will engage the ends 110 of the rim 30 so that not only can the containers be stacked one on top of the other without nesting, but when thus stacked will be completely stable.

We claim:

1. A container comprising:

a flat base having upper and lower faces and an outer rectangular peripheral edge having a pair of substantially parallel main sides and a pair of substantially parallel minor sides bridging said main sides, said main sides and one of said minor sides together defining a U-shape;

an array substantially of said U-shape of generally parallel strips extending generally perpendicularly upwardly from said base and each having a lower end secured to said outer peripheral edge and an upper end, said strips each having a predetermined width measured parallel to said edge and a predetermined thickness measured perpendicular to said edge, said strips being generally equispaced at least along said main sides of said edge by a distance equal to at least said width; and a flat rim having an inner edge of substantially said U-shape but larger in at least one direction parallel to said minor sides of said base than the corresponding portion of said peripheral outer edge of said base by a difference equal to at least twice said thickness, said upper ends being secured to said inner edge, said container being open parallel to said base at said minor side whereby two at least of said containers can nest within each other with the lower face of the upper container resting on the upper face of the lower container, the strips of the containers interleaved, and the upper container offset parallel to said major sides from the lower container to project from the open other minor side thereof.

2. The container defined in claim 1 wherein said strips have a predetermined length equal generally to a multiple of their width, said distance being generally equal to the same multiple of said width.

3. The container defined in claim 1 wherein said distance is generally equal to a whole-number multiple of said width.

4. The container defined in claim 1 wherein said distance is generally equal to a whole-number multiple of said width, whereby a plurality of said containers can be nested.

5. The container defined in claim 4 wherein said number is more than one.

6. The container defined in claim 1 wherein said strips, base, and rim are integrally made of synthetic-resin material, said strips forming an angle of between 90° and 105° with said base.

7. The container defined in claim 1 wherein when two of said containers are nested within each other the upper container projects through the open other minor side of the lower container by a distance equal generally to said predetermined width.

8. The container defined in claim 1 wherein said container is substantially mirror-symmetrical about a plane equidistant between and parallel to said major sides.

* * * * *